US009540835B1

(12) United States Patent
Pennacchia

(10) Patent No.: US 9,540,835 B1
(45) Date of Patent: Jan. 10, 2017

(54) UMBRELLA POOL COVER

(71) Applicant: Felice Pennacchia, Staten Island, NY (US)

(72) Inventor: Felice Pennacchia, Staten Island, NY (US)

( * ) Notice: Subject to any disclaimer, the term of this patent is extended or adjusted under 35 U.S.C. 154(b) by 453 days.

(21) Appl. No.: 14/077,542

(22) Filed: Nov. 12, 2013

(51) Int. Cl.
*E04H 4/10* (2006.01)

(52) U.S. Cl.
CPC ..... *E04H 4/108* (2013.01)

(58) Field of Classification Search
CPC ..... E04H 4/108
See application file for complete search history.

(56) References Cited

U.S. PATENT DOCUMENTS

| | | | |
|---|---|---|---|
| 3,475,768 | A | 11/1969 | Burton |
| 3,683,427 | A | 8/1972 | Burkholz et al. |
| 5,640,811 | A | 6/1997 | Boyle et al. |
| D388,180 | S | 12/1997 | Weihbrecht |
| 6,381,767 | B1 | 5/2002 | Brashears |
| 6,807,688 | B1 | 10/2004 | Popowski et al. |
| D512,514 | S | 12/2005 | Calvaruso et al. |
| 7,874,023 | B1 | 1/2011 | Sundling |
| 2005/0072055 | A1 | 4/2005 | Martin |
| 2006/0101569 | A1 | 5/2006 | Tripp |

*Primary Examiner* — Tuan N Nguyen

(57) ABSTRACT

The umbrella pool cover includes a frame assembly that is specially designed for use in covering a pool. The frame assembly includes a tubular member coupled to a pool. The tubular member extends toward a center of the pool. A central dome is coupled to the tubular member. The dome is supported above the pool. A cover is positionable on the tubular member and the dome so the cover may cover the pool.

8 Claims, 7 Drawing Sheets

UMBRELLA POOL COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of pool covers, more specifically, umbrella pool covers.

SUMMARY OF THE INVENTION

An embodiment of the disclosure meets the needs presented above by generally comprising a tubular member coupled to a pool. The tubular member extends toward a center of the pool. A central dome is coupled to the tubular member. The dome is supported above the pool. A cover is positionable on the tubular member and the dome so the cover may cover the pool.

These together with additional objects, features and advantages of the umbrella pool cover will be readily apparent to those of ordinary skill in the art upon reading the following detailed description of presently preferred, but nonetheless illustrative, embodiments of the umbrella pool cover when taken in conjunction with the accompanying drawings.

In this respect, before explaining the current embodiments of the umbrella pool cover in detail, it is to be understood that the umbrella pool cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the umbrella pool cover.

It is therefore important that the claims be regarded as including such equivalent construction insofar as they do not depart from the spirit and scope of the umbrella pool cover. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
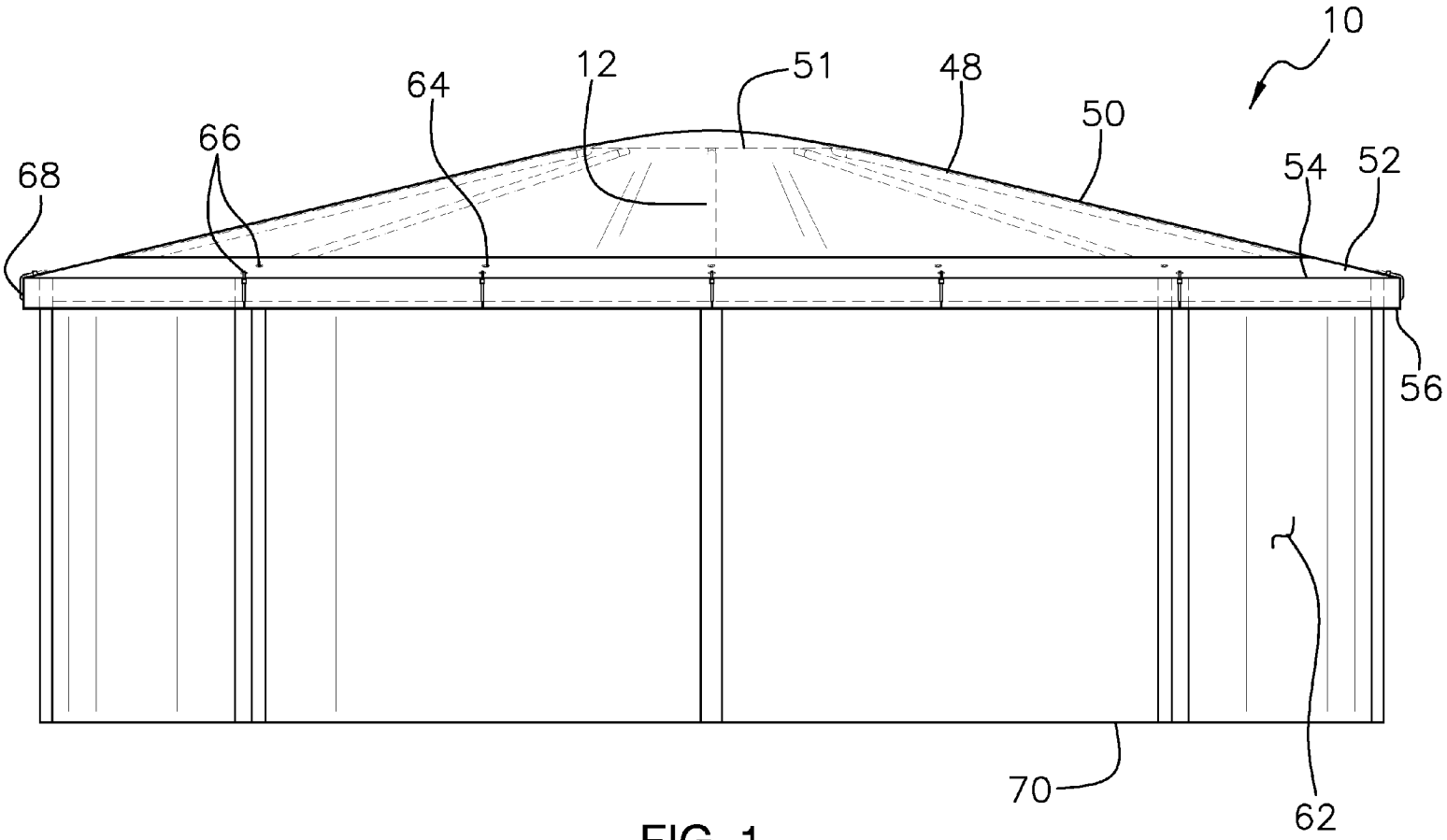
FIG. 1 is a perspective view of a frame assembly according to an embodiment of the disclosure.
Figure 2:
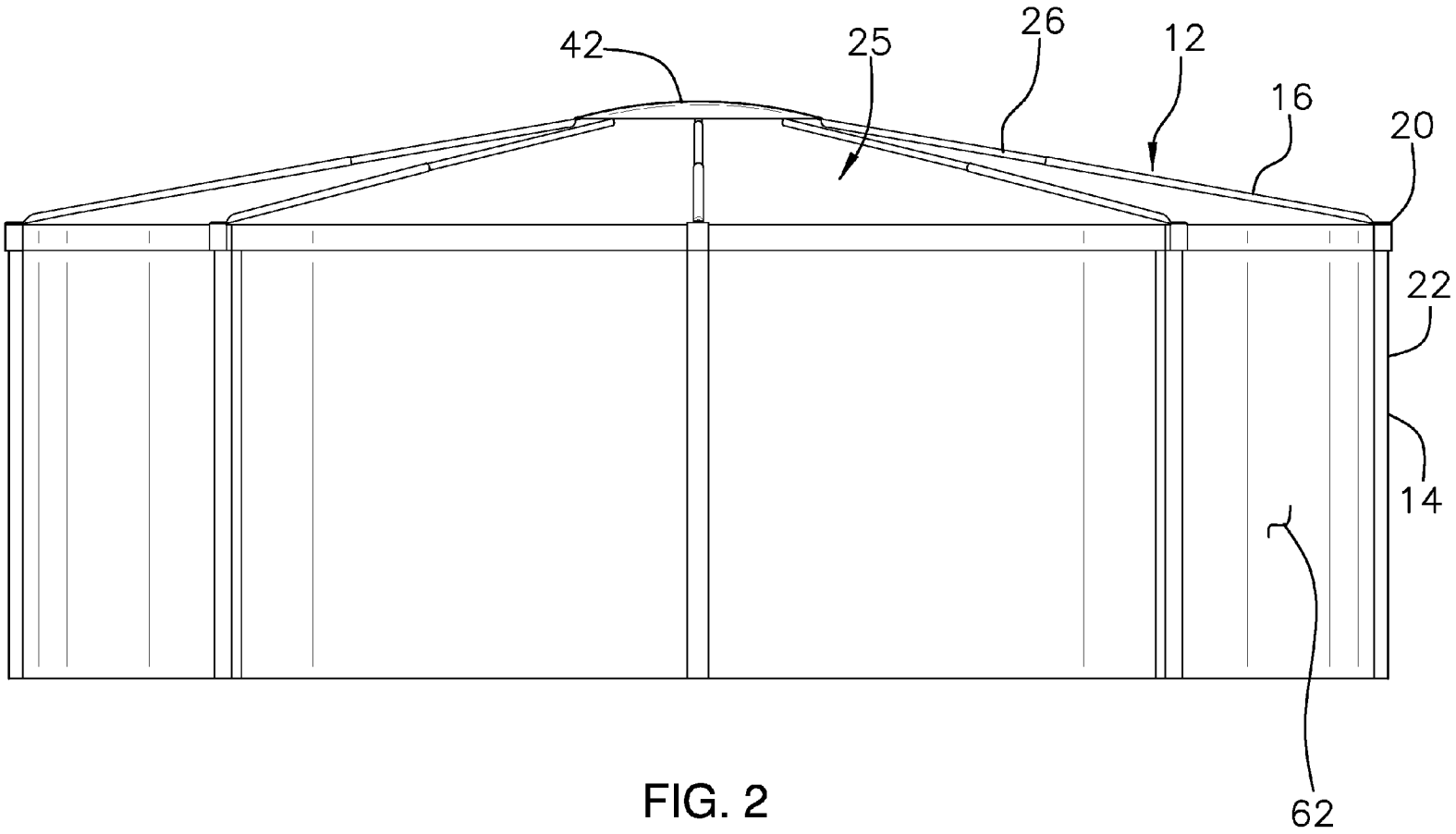
FIG. 2 is a side view of an embodiment of the disclosure.
Figure 3:
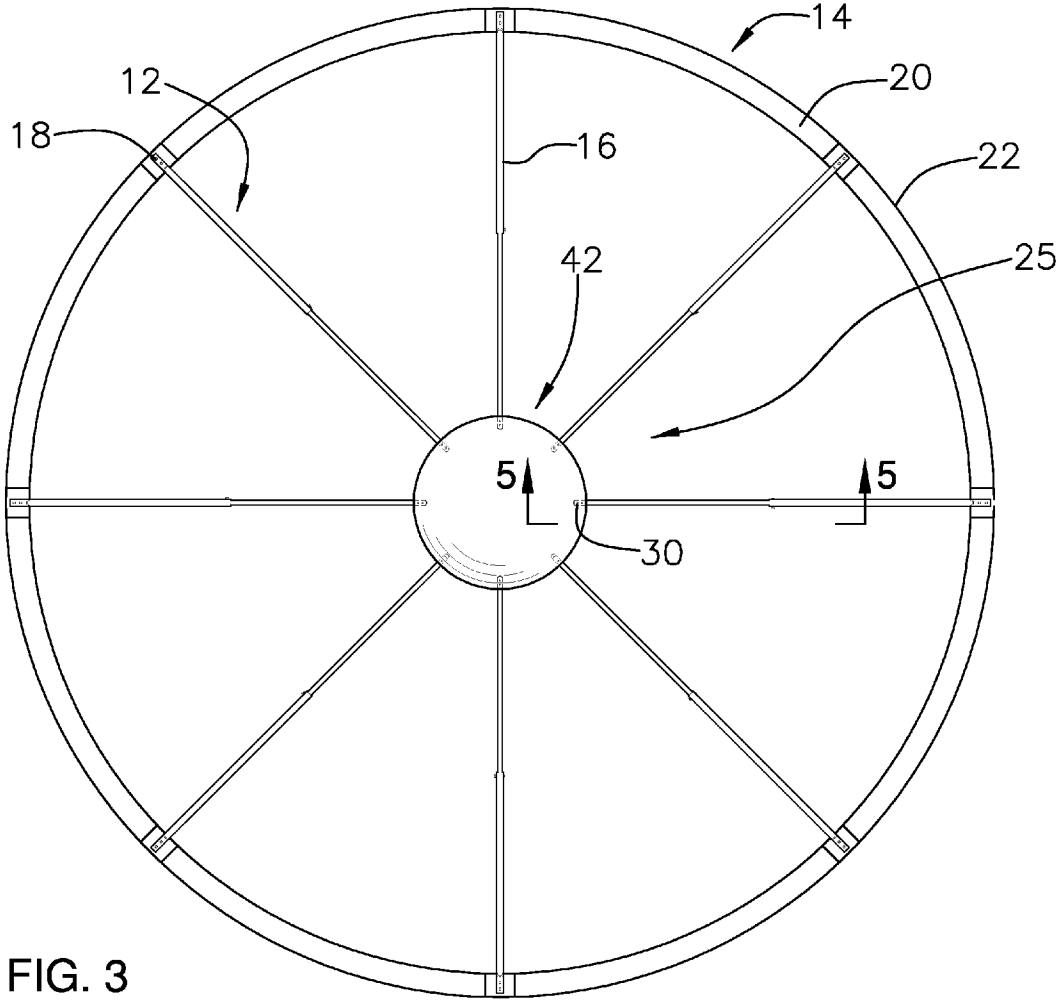
FIG. 3 is a top view of an embodiment of the disclosure.
Figure 4:
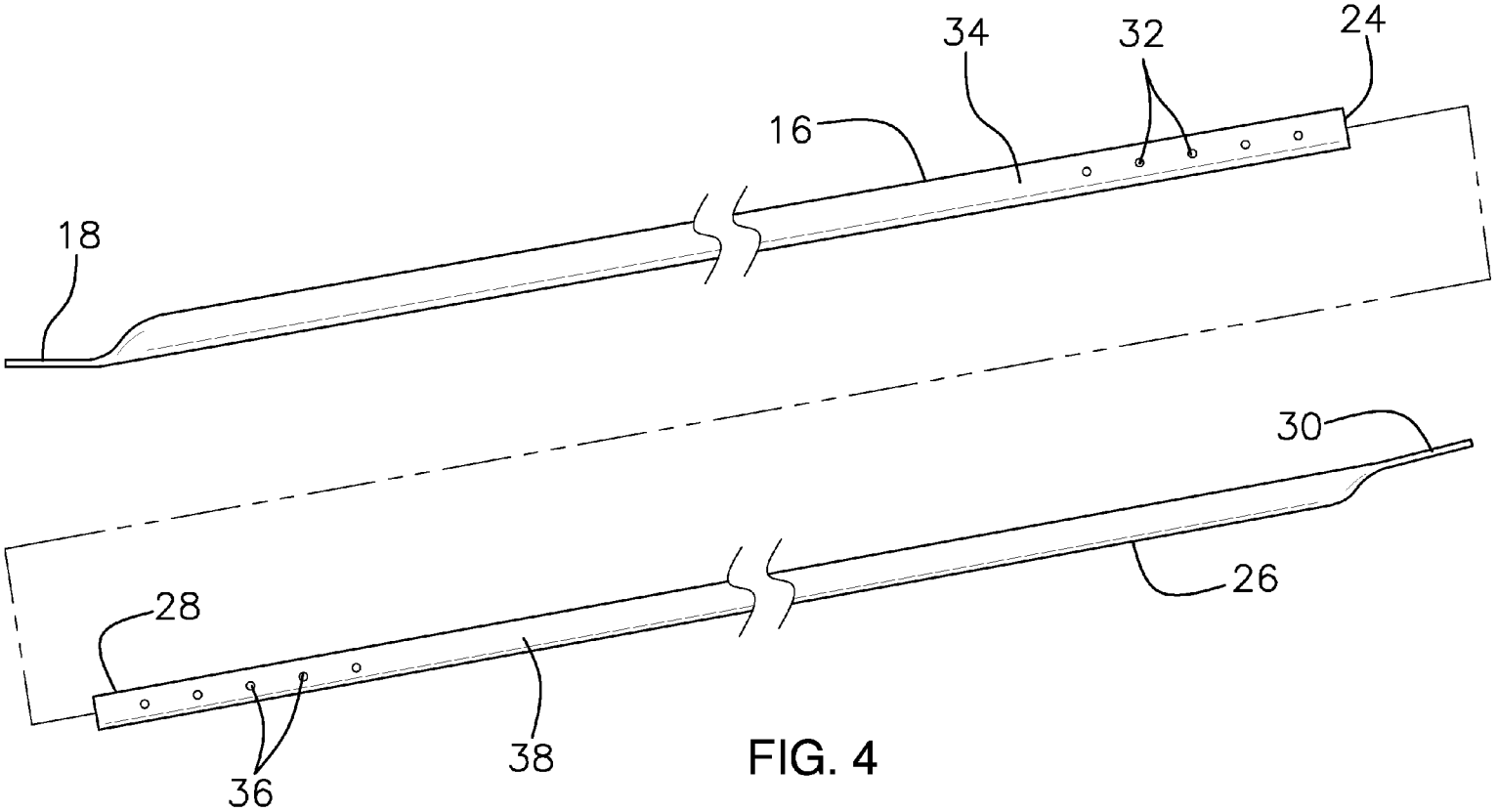
FIG. 4 is an exploded side view of an embodiment of the disclosure.
Figure 5:
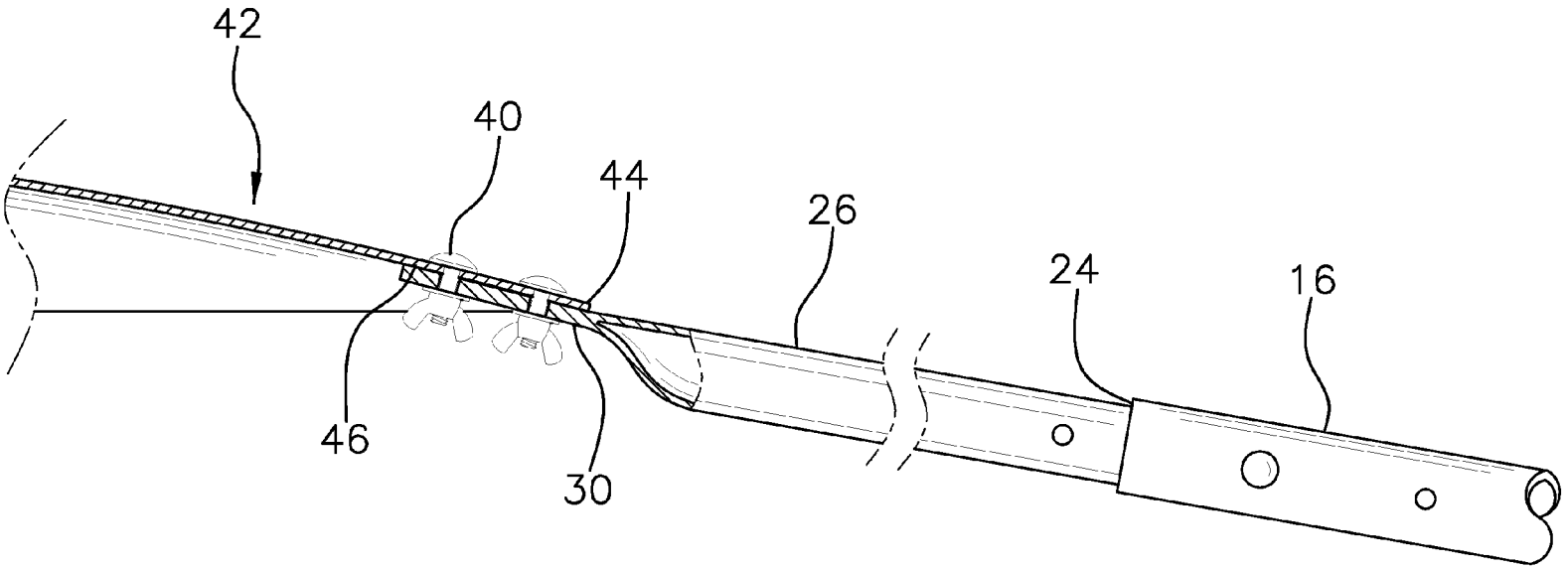
FIG. 5 is a cross sectional view taken along line 5-5 of FIG. 3 of an embodiment of the disclosure.
Figure 6:
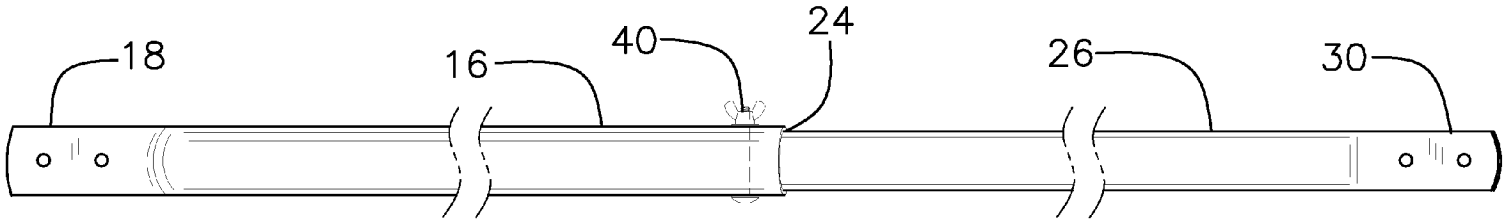
FIG. 6 is a bottom view of an embodiment of the disclosure.
Figure 7:
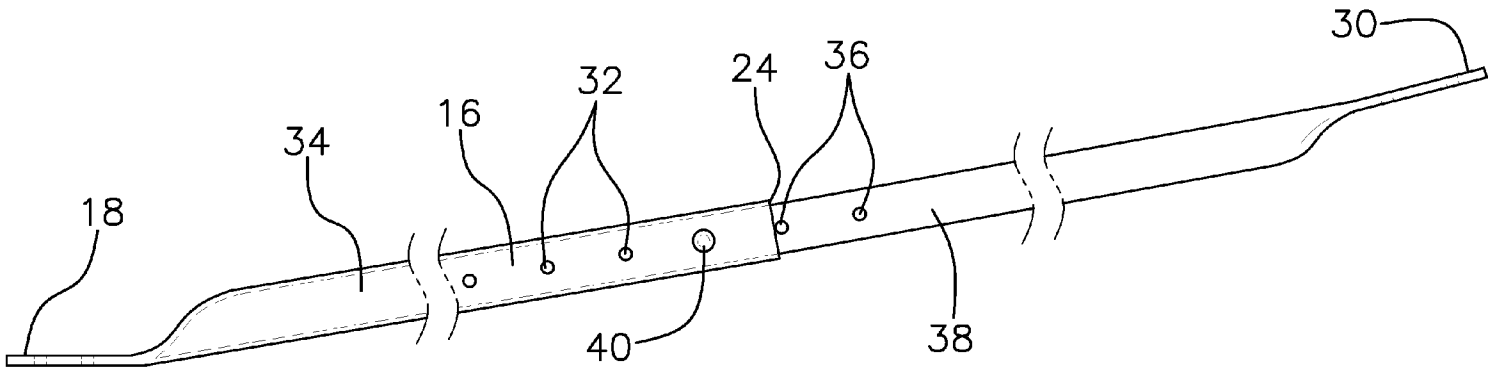
FIG. 7 is a right side view of an embodiment of the disclosure.
Figure 8:
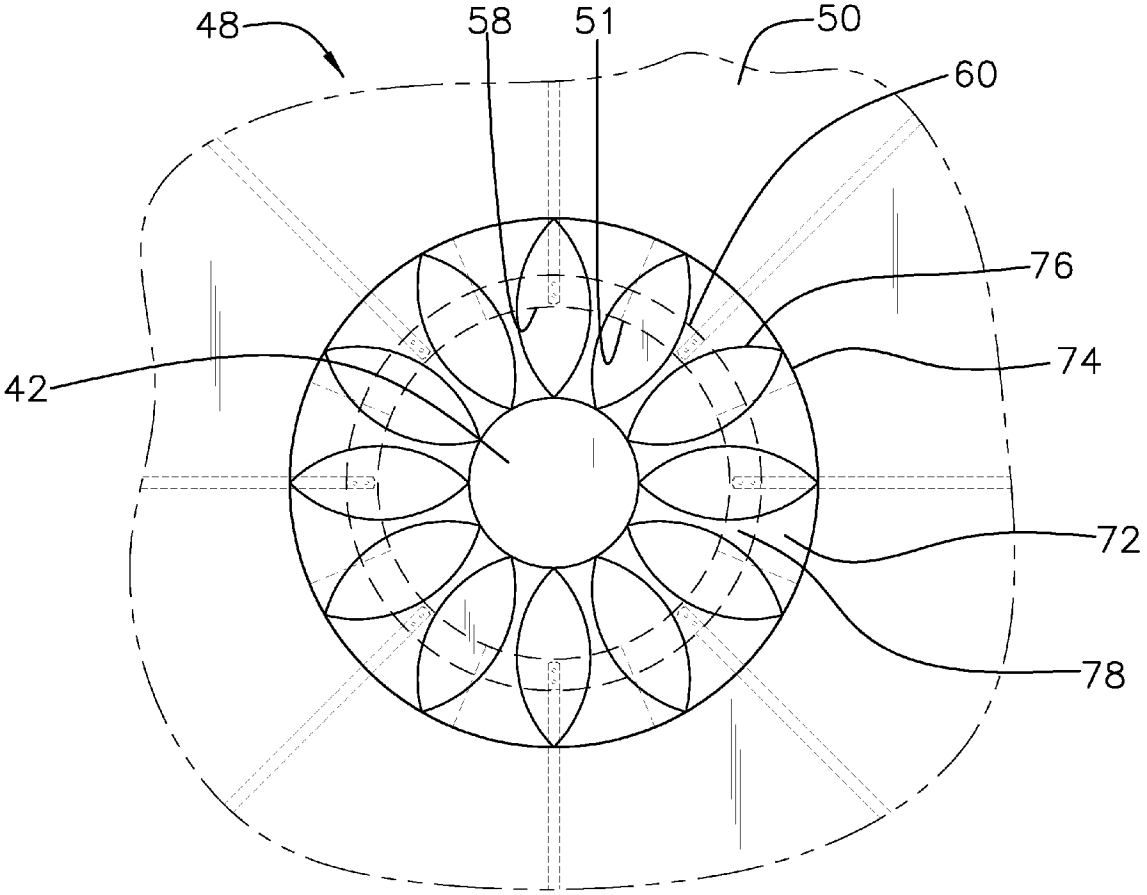
FIG. 8 is an in-use view of an embodiment of the disclosure.

As best illustrated in FIGS. 1 through 8, the frame assembly 10 (hereinafter assembly) generally comprises a tubular member 12 coupled to a pool 14. The pool 14 may be an above ground pool of any conventional design. Further, the tubular member 12 includes a first portion of the tubular member 16. A flat end 18 of the first portion of the tubular member 16 is coupled to a top side 20 of an outside wall 22 of the pool 14. Moreover, an open end 24 of the first portion of the tubular member 16 is directed toward a center 25 of the pool 12. The first portion of the tubular member 16 may have a length between 120 cm and 180 cm.

The tubular member 12 further includes a second portion of the tubular member 26. An open end 28 of the second portion of the tubular member 26 is insertably coupled to the open end 24 of the first portion of the tubular member 16. Additionally, a flat end 30 of the second portion of the tubular member 26 is directed toward the center 25 of the pool 12. The second portion of the tubular member 26 may have a length between 120 cm and 180 cm. Lastly, the second portion of the tubular member 26 has a diameter that is less than a diameter of the first portion of the tubular member 16.

A plurality of first fastener apertures 32 extends laterally through an outside wall 34 of the first portion of the tubular member 16. The plurality of first fastener apertures 32 is spaced apart from the open end 24 of the first portion of the tubular member 16. Further, a plurality of second fastener apertures 36 extends laterally through an outside wall 38 of the second portion of the tubular member 26. The plurality of second fastener apertures 36 is spaced apart from the open end 28 of the second portion of the tubular member 26. Continuing, at least one fastener 40 extends through a selected pair of the first 32 and second 36 fastener apertures. The fastener 40 retains the second portion of the tubular member 26 on the first portion of the tubular member 16. Lastly, the fastener 40 may be a nut and bolt of any conventional design.

A central dome 42 is selectively coupled to the tubular member 12 so the central dome 42 is supported above the pool 14. The plurality of tubular members 12 extends upwardly from the outside wall 22 of the pool 14 toward the central dome 42. Additionally, the central dome 42 may have a diameter between 60 cm and 92 cm. The flat end 30 of the second portion of the tubular member 26 is coupled to the central dome 42.

A top surface 44 of the flat end 30 of the second portion of the tubular member 26 abuts a bottom surface 46 of the central dome 42. At least one fastener 40 extends through the flat end 30 of the second portion of the tubular member 26 and engages the central dome 42. The fastener(s) 40 retains the second portion of the tubular member 26 on the central dome 42. The fastener 40 may be a nut and bolt of any conventional design.

The tubular member 12 is one of a plurality of tubular members 12. The plurality of tubular members 12 is evenly distributed around the outside wall 22 of the pool 14 so the plurality of tubular members 12 radiates around the central dome 42. A cover 48 is positionable on the plurality of tubular members 12 and the central dome 42 so the cover 48 may cover the pool 14. Lastly, the cover 48 may be comprised of a deformable and fluid impermeable material.

The cover 48 is one of a pair of covers 48. A first one of the pair of covers 50 has a centrally positioned opening 51 so the first cover 50 has a donut shape. Continuing, the first cover 50 may have a diameter between 3 m and 6 m. A skirt 52 is coextensively coupled to and extends downwardly from an outside edge 54 of the first cover 50. The skirt 52 may have a height between 15 cm and 25 cm. Lastly, a bottom edge 56 of the skirt 52 comprises a sawtooth pattern.

The first cover 50 is positionable over the plurality of tubular members 12 so an inside edge 58 of the centrally positioned opening 51 in the first cover 50 is curvilinear with an outside edge 60 of the central dome 42. Moreover, the inside edge 58 of the centrally positioned opening 51 is spaced upwardly on the central dome 42 from the outside edge 60 of the central dome 42. The centrally positioned opening 51 has a diameter that is less than a diameter of the central dome 42. The outside edge 54 of the first cover 50 is coextensive with the outside wall 22 of the pool 14 so the skirt 52 extends downwardly along an outer surface 62 of the outside wall 22 of the pool 14.

A grommet 64 extends through the skirt 52. The grommet 64 may have a diameter between 1 cm and 3 cm. Continuing, the grommet 64 is one of a plurality of evenly spaced pair of grommets 66. The evenly spaced pair of grommets 66 are evenly distributed around the skirt 52. A plurality of straps 68 is selectively coupled between an associated one of the plurality grommets 66 and the skirt 52. The plurality of straps 68 retains the first cover 50 on the pool 14.

A second one of the pairs of covers 72 is positionable on the central dome 42 after the first cover 52 is positioned on the plurality of tubular members 12. An outer edge 74 of the second cover 72 is spaced downwardly from the inside edge 58 of the centrally positioned opening 51 so the second cover 72 overlaps the first cover 52. Continuing, the second cover 72 may have a diameter between 120 cm and 150 cm. Indicia 76 may be printed on a top side 78 of the second cover 72. The indicia 76 may comprise a floral pattern.

In use, the plurality of tubular members 12 and the central dome 42 are coupled to the pool 14 when the pool 14 is to be taken out of service for an extended period of time. Additionally, the first 52 and second 72 covers may be left on the plurality of tubular members 12 for an extended period of time. Further, the first 52 and second 72 covers may be removed at any time to perform maintenance on the pool 14 or for any other reason. When the pool 14 is to be returned to normal use, the assembly 10 is removed from the pool.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A frame assembly for covering a pool comprising:

a tubular member coupled to the pool wherein said tubular member extends toward a center of the pool;

a central dome coupled to said tubular member wherein said dome is supported above the pool; and a cover being positionable on said tubular member and said dome wherein said cover is configured to cover the pool;

wherein said cover being one of a pair of covers;

wherein a first one of said pair of covers having a centrally positioned opening;

wherein said first cover has a donut shape;

wherein a second one of said pairs of covers being positionable on said central dome after the first cover is positioned on a plurality of tubular members;

wherein an outer edge of said second cover is spaced downwardly from an inside edge of the centrally positioned opening;

wherein said second cover overlaps said first cover;

wherein a skirt coextensively coupled to and extending downwardly from an outside edge of said first cover;

wherein said first cover being positionable over a plurality of said tubular members;

wherein the inside edge of the centrally positioned opening in said first cover is curvilinear with an outside edge of said central dome;

wherein said inside edge of said centrally positioned opening is spaced upwardly on said central dome from said outside edge of said central dome;

wherein an outside edge of said first cover is coextensive with an outside wall of the pool;

wherein said skirt extends downwardly along an outer surface of the outside wall of the pool;

wherein a first portion of said tubular member comprising a flat end of said first portion of said tubular member being coupled to a top side of an outside wall of the pool;

wherein an open end of said first portion of said tubular member is directed toward the center of the pool;

wherein a second portion of said tubular member comprising an open end of said second portion of said tubular member being insertably coupled to an open end of a first portion of said tubular member;

wherein a flat end of said second portion of said tubular member is directed toward the center of the pool;

wherein a grommet extending through said skirt;

wherein said grommet being one of a pair of evenly spaced grommets;

wherein the evenly spaced grommets are evenly distributed around said skirt.

2. The assembly according to claim 1 wherein a plurality of first fastener apertures extending laterally through an outside wall of a first portion of said tubular member such that said plurality of first fastener apertures is spaced apart from an open end of said first portion of said tubular member.

3. The assembly according to claim 1 wherein a plurality of second fastener apertures extending laterally through an outside wall of a second portion of said tubular member such that said plurality of second fastener apertures is spaced apart from an open end of said second portion of said tubular member.

4. The assembly according to claim 1 wherein a fastener extending through a selected pair of a first and a second fastener aperture; wherein a second portion of said tubular member is retained on a first portion of said tubular member.

5. The assembly according to claim 1 wherein a flat end of a second portion of said tubular member being coupled to said central dome; wherein a top surface of said flat end of said second portion of said tubular member abuts a bottom surface of said central dome.

6. The assembly according to claim 1 wherein said tubular member being one of a plurality of tubular members.

7. The assembly according to claim 6 wherein said plurality of tubular members being evenly distributed around an outside wall of the pool; wherein said plurality of tubular members radiates around said central dome.

8. A frame assembly for covering a pool comprising:

a tubular member coupled to the pool, said tubular member comprising;

a first portion of said tubular member comprising a flat end of said first portion of said tubular member being coupled to a top side of an outside wall of the pool wherein an open end of said first portion of said tubular member is directed toward a center of the pool;

a second portion of said tubular member comprising an open end of said second portion of said tubular member being insertably coupled to said open end of said first portion of said tubular member wherein a flat end of said second portion of said tubular member is directed toward the center of the pool;

a plurality of first fastener apertures extending laterally through an outside wall of said first portion of said tubular member such that said plurality of first fastener apertures is spaced apart from said open end of said first portion of said tubular member;

a plurality of second fastener apertures extending laterally through an outside wall of said second portion of said tubular member such that said plurality of second fastener apertures is spaced apart from said open end of said second portion of said tubular member;

a fastener extending through a selected pair of said first and second fastener apertures wherein said second portion of said tubular member is retained on said first portion of said tubular member;

a central dome coupled to said tubular member wherein said dome is supported above the pool, said flat end of said second portion of said tubular member being coupled to said central dome wherein a top surface of said flat end of said second portion of said tubular member abuts a bottom surface of said central dome;

said tubular member being one of a plurality of tubular members, said plurality of tubular members being evenly distributed around the outside wall of the pool wherein said plurality of tubular members radiates around said central dome;

a cover being positionable on said plurality of tubular members and said central dome wherein said cover is configured to cover the pool, said cover being one of a pair of covers;

a first one of said pair of covers having a centrally positioned opening wherein said first cover has a donut shape;

a skirt coextensively coupled to and extending downwardly from an outside edge of said first cover, said first cover being positionable over said plurality of tubular members wherein an inside edge of said centrally positioned opening in said first cover is curvilinear with an outside edge of said central dome wherein said inside edge of said centrally positioned opening is spaced upwardly on said central dome from said outside edge of said central dome wherein said outside edge of said first cover is coextensive with the outside wall of the pool wherein said skirt extends downwardly along an outer surface of the outside wall of the pool;

a grommet extending through said skirt, said grommet being one of a plurality of evenly spaced grommets, said evenly spaced grommets being evenly distributed around said skirt; and a second one of said pairs of covers being positionable on said central dome after said first cover is positioned on said plurality of tubular members wherein an outer edge of said second cover is spaced downwardly from said inside edge of said centrally spaced opening wherein said second cover overlaps said first cover.

* * * * *